US011604425B2

(12) United States Patent
Seki et al.

(10) Patent No.: US 11,604,425 B2
(45) Date of Patent: Mar. 14, 2023

(54) FIXING DEVICE AND IMAGE FORMING APPARATUS INCORPORATING SAME

(71) Applicants: Takayuki Seki, Kanagawa (JP); Yuusuke Furuichi, Kanagawa (JP)

(72) Inventors: Takayuki Seki, Kanagawa (JP); Yuusuke Furuichi, Kanagawa (JP)

(73) Assignee: RICOH COMPANY LTD., Tokyo (JP)

( * ) Notice: Subject to any disclaimer, the term of this patent is extended or adjusted under 35 U.S.C. 154(b) by 0 days.

(21) Appl. No.: 17/582,371

(22) Filed: Jan. 24, 2022

(65) Prior Publication Data

US 2022/0291610 A1 Sep. 15, 2022

(30) Foreign Application Priority Data

Mar. 12, 2021 (JP) ..... JP2021-040735

(51) Int. Cl.
*G03G 15/20* (2006.01)
*G03G 21/16* (2006.01)

(52) U.S. Cl.
CPC ..... *G03G 15/2039* (2013.01); *G03G 15/2017* (2013.01); *G03G 15/2053* (2013.01); *G03G 21/1647* (2013.01); *G03G 21/1685* (2013.01)

(58) Field of Classification Search
CPC ..... G03G 15/2039; G03G 15/2053; G03G 21/1647; G03G 21/1685; G03G 15/2017
See application file for complete search history.

(56) References Cited

U.S. PATENT DOCUMENTS

2010/0054786 A1* 3/2010 Hara ..... G03G 15/2039 399/69
2011/0158719 A1 6/2011 Miyauchi et al.
2012/0201558 A1 8/2012 Watanabe
2017/0371283 A1* 12/2017 Fujita ..... G03G 15/2053
2019/0004458 A1 1/2019 Muramatsu et al.
2019/0171144 A1 6/2019 Fujita et al.
2019/0179242 A1 6/2019 Adachi et al.
2019/0196374 A1 6/2019 Adachi et al.
2019/0278206 A1 9/2019 Adachi et al.
(Continued)

FOREIGN PATENT DOCUMENTS

JP 2015-118366 6/2015
JP 2018-036549 3/2018
(Continued)

OTHER PUBLICATIONS

Extended European Search Report dated Jun. 30, 2022 issued in corresponding European Appln. No. 22155534.5.

*Primary Examiner* — Sophia S Chen
(74) *Attorney, Agent, or Firm* — Harness, Dickey & Pierce, P.L.C.

(57) ABSTRACT

A fixing device includes a fixing rotator, an opposing rotator, a temperature detector, and a support. The fixing rotator has a hollow and heats an image to fix the image onto a recording medium. The opposing rotator forms a fixing nip between the fixing rotator and the opposing rotator. The temperature detector includes an exposed conductive portion. The support has conductivity and is disposed in the hollow of the fixing rotator to support the fixing rotator at the fixing nip. The support has at least one of a recessed portion or an opening at a position facing the exposed conductive portion of the temperature detector.

18 Claims, 9 Drawing Sheets

(56) References Cited

U.S. PATENT DOCUMENTS

| | | | |
|---|---|---|---|
| 2019/0286027 | A1 | 9/2019 | Someya et al. |
| 2019/0286029 | A1 | 9/2019 | Adachi et al. |
| 2020/0033766 | A1 | 1/2020 | Hase et al. |
| 2020/0033767 | A1 | 1/2020 | Adachi et al. |
| 2020/0033775 | A1 | 1/2020 | Inoue et al. |
| 2020/0249601 | A1 | 8/2020 | Inoue et al. |
| 2020/0401067 | A1 | 12/2020 | Samei et al. |

FOREIGN PATENT DOCUMENTS

| | | |
|---|---|---|
| JP | 2019-117377 | 7/2019 |
| JP | 2020-098311 | 6/2020 |
| JP | 2020-101673 | 7/2020 |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2021-040735, filed on Mar. 12, 2021 in the Japan Patent Office, the entire disclosure of which is incorporated by reference herein.

BACKGROUND

Technical Field

Embodiments of the present disclosure generally relate to a fixing device and an image forming apparatus incorporating the fixing device.

Related Art

One type of fixing device includes a fixing rotator having a hollow and heating an image to fix the image onto a recording medium, an opposing rotator forming a fixing nip between the fixing rotator and the opposing rotator, a conductive support disposed inside the hollow of the fixing rotator to support a part of the fixing rotator on the fixing nip, and a temperature detector that detects a temperature of the fixing rotator.

SUMMARY

This specification describes an improved fixing device that includes a fixing rotator, an opposing rotator, a temperature detector, and a support. The fixing rotator has a hollow and heats an image to fix the image onto a recording medium. The opposing rotator forms a fixing nip between the fixing rotator and the opposing rotator. The temperature detector includes an exposed conductive portion. The support has conductivity and is disposed in the hollow of the fixing rotator to support the fixing rotator at the fixing nip. The support has at least one of a recessed portion or an opening at a position facing the exposed conductive portion of the temperature detector.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
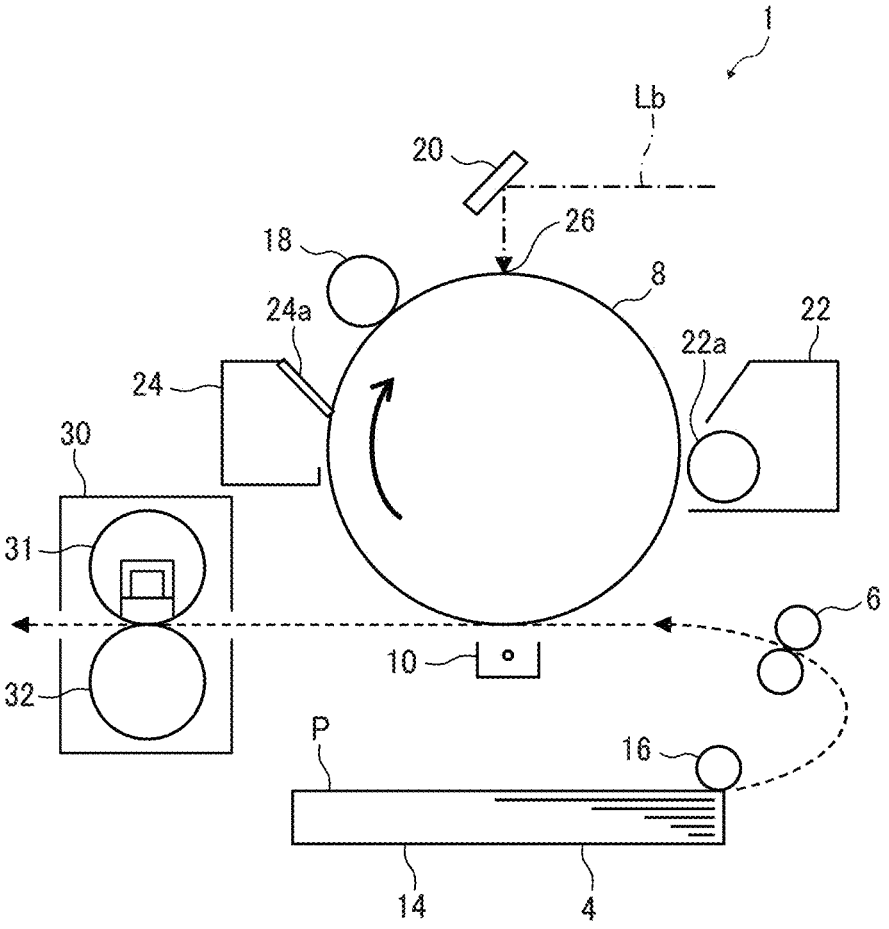
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

With reference to drawings attached, a description is given below of the present disclosure. In the drawings for illustrating embodiments of the present disclosure, identical reference numerals are assigned to elements such as members and parts that have an identical function or an identical shape as long as differentiation is possible, and descriptions of such elements may be omitted once the description is provided.

Initially with reference to FIG. 1, a description is given of a basic configuration of an electrophotographic image forming apparatus according to an embodiment of the present disclosure.

The image forming apparatus is a printer. Alternatively, the image forming apparatus may be a copier, a facsimile machine, a multifunction peripheral (MFP) having at least two of printing, copying, facsimile, scanning, and plotter functions, or the like. In the present embodiment, the image forming apparatus is a one drum type image forming apparatus including one photoconductor drum but may be a tandem image forming apparatus including a plurality of photoconductor drums. In the present embodiment, the image forming apparatus uses a direct transfer method in which a toner image is directly transferred from the photoconductor drum to a sheet but may use an intermediate transfer method in which the toner image is transferred from photoconductor drum to the sheet via an intermediate transferor.

FIG. 1 is a diagram illustrating a schematic configuration of the image forming apparatus according to the present embodiment.

As illustrated in FIG. 1, the image forming apparatus 1 according to the present embodiment, herein serving as the printer, includes a sheet feeder 4, a registration roller pair 6, a photoconductor drum 8 serving as an image bearer, a transfer device 10, and a fixing device 30. The sheet feeder 4 includes a sheet feed tray 14 and a feed roller 16. The sheet feed tray 14 accommodates a stack of sheets P serving as recording media. The feed roller 16 sequentially separates and feeds an uppermost sheet from the stack of sheets P accommodated in the sheet feed tray 14. The registration roller pair 6 temporarily stops the uppermost sheet P fed by the feed roller 16 to correct the skew of the sheet P. Next, the registration roller pair 6 sends the sheet P to the transfer device 10 at a timing synchronizing rotation of the photoconductor drum 8, that is, the timing at which a leading edge of a toner image formed on the photoconductor drum 8 meets a certain position of a leading edge of the sheet P in a sheet conveyance direction.

Around the photoconductor drum 8, the image forming apparatus includes a charging roller 18 as a charging device, a mirror 20 that is a part of an exposure device as a latent image forming device, a developing device 22 including a developing roller 22*a*, the transfer device 10, and a cleaning device 24 as a cleaner including a cleaning blade 24*a* in order of rotation of the photoconductor drum 8 indicated by arrow in FIG. 1. The exposure device irradiates and scans an exposure section 26 between the charging roller 18 and the developing device 22 on the photoconductor drum 8 with an exposure light Lb via the mirror 20.

After the photoconductor drum 8 starts to rotate, the charging roller 18 uniformly charges the surface of the photoconductor drum 8, and the exposure device irradiates and scans the exposure section 26 with the exposure light Lb based on image data to form an electrostatic latent image corresponding to the image data on the surface of the photoconductor drum 8. The rotation of the photoconductor drum 8 moves the electrostatic latent image to a position facing the developing device 22. At the position, the developing device 22 supplies toner to the electrostatic latent image to visualize the electrostatic latent image as a toner image.

The transfer device 10 charges the sheet P entering a region over the transfer device 10 at a predetermined timing to transfer the toner image formed on the photoconductor drum 8 onto the sheet P. After the transfer device 10 transfers the toner image from the photoconductor drum 8 onto the sheet P, the sheet P bearing the toner image is conveyed toward the fixing device 30, and the fixing device 30 fixes the toner image onto the sheet P. After that, the sheet P is ejected and stacked on an output tray.

The residual toner remaining on the photoconductor drum 8 without being transferred from the photoconductor drum 8 to the sheet P at the region above the transfer device 10 reaches the cleaning device 24 as the photoconductor drum 8 rotates, and the cleaning blade 24*a* scrapes the residual toner to clean the surface of the photoconductor drum 8 while the residual toner passes through the cleaning device 24. After the cleaning device 24 cleans the photoconductor drum 8, a discharger discharges a residual potential on the photoconductor drum 8, and the photoconductor drum 8 is prepared for the next image forming operations.

Next, a configuration and operations of the fixing device 30 according to the present embodiment are described.

Figure 2:
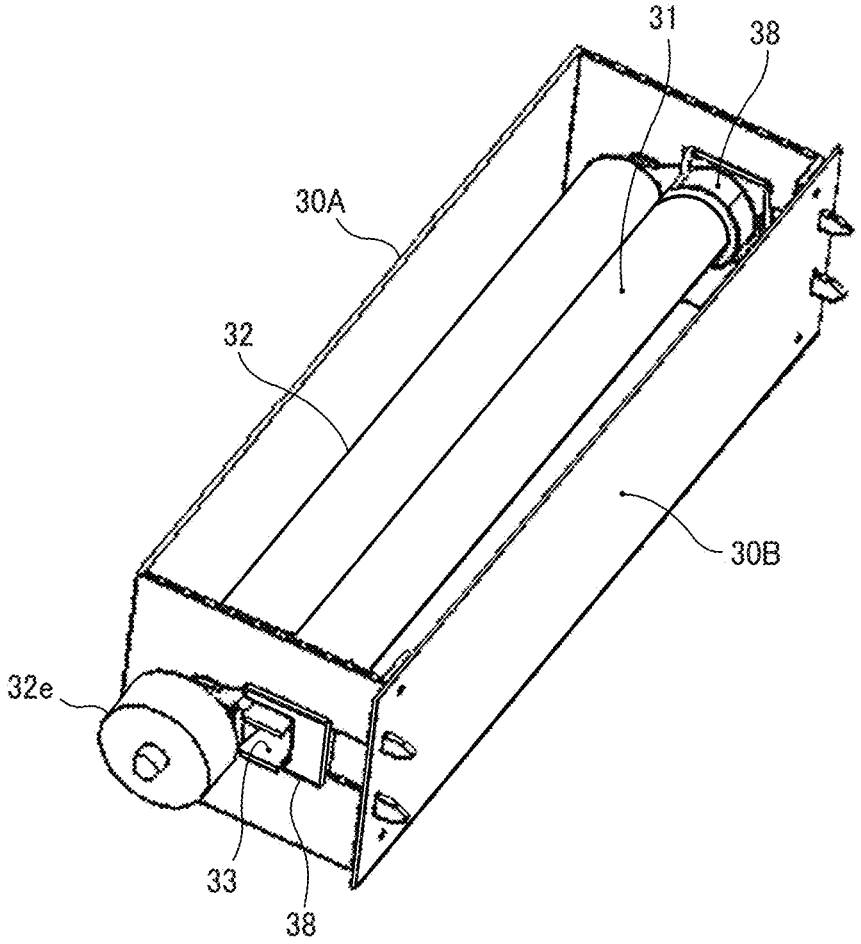
FIG. 2 is a perspective view of a fixing device in the image forming apparatus of FIG. 1 to illustrate a configuration of the fixing device.
Figure 3:
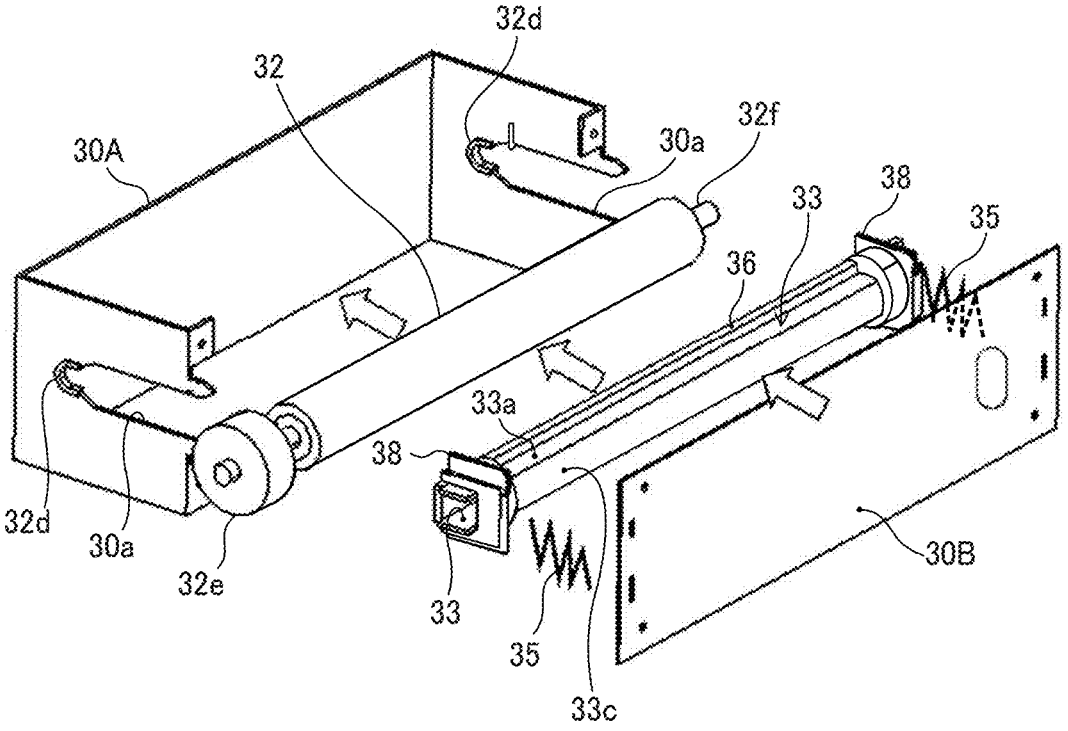
FIG. 3 is an exploded perspective view of the fixing device of FIG. 2 in which a fixing belt is removed.

FIG. 2 is a perspective view of the fixing device 30 to illustrate the configuration of the fixing device 30 according to the present embodiment. FIG. 3 is an exploded perspective view of the fixing device 30 according to the present embodiment in which a fixing belt is removed.

As illustrated in FIG. 2, the fixing device 30 according to the present embodiment includes a fixing belt 31 and a pressure roller 32. The fixing belt 31 is an endless belt serving as a fixing rotator that is a fixing member. The pressure roller 32 serves as an opposing rotator that is an opposing member forming a fixing nip SN between the fixing belt 31 and the pressure roller 32. The fixing device 30 includes a first frame 30A and a second frame 30B that are joined to each other by screws or the like. The fixing belt 31 and the pressure roller 32 are disposed between the first frame 30A and the second frame 30B.

As illustrated in FIG. 3, the first frame 30A includes two side plates that support both end portions 32*f* of the cored bar 32*a* of the pressure roller 32 and a bridge plate that connects the two side plates. The first frame 30A may be made by bending one sheet metal or by fastening separate parts that are the two side plates and the bridge plate to each other with screws or the like.

As illustrated in FIG. 3, each side plate of the first frame 30A has a cutout 30*a* to insert an end portion 32*f* of the cored bar 32*a* of the pressure roller 32, and a pressure roller bearing 32*d* that is a sliding bearing fitted into the cutout 30*a*. In the present embodiment, the pressure roller bearing 32*d* is the sliding bearing but may be a ball bearing. As illustrated in FIG. 3, a pressure roller gear 32*e* is fixed to one end of the pressure roller 32. The pressure roller gear 32*e* is coupled to a drive gear disposed in the image forming apparatus body and driven to rotate.

To assemble the fixing device 30, the pressure roller 32 is inserted into the cutouts 30*a* of the first frame 30A, and the end portions 32*f* of the cored bar 32*a* of the pressure roller 32 are fitted into the pressure roller bearings 32*d*. As a result, the pressure roller 32 is rotatably supported by the first frame 30A. Subsequently to the pressure roller 32, the belt module including the fixing belt 31 is inserted into the cutouts 30*a* of the first frame 30A. Thereafter, the second frame 30B is set on the first frame 30A so as to cover the openings of the cutouts 30*a*, and the first frame 30A and the second frame 30B are fastened to each other.

As illustrated in FIG. 3, pressure springs (that are compression springs) 35 as biasing members are disposed between the second frame 30B and the belt module. Pressing force of the pressure springs 35 presses the belt module including the fixing belt 31 against the pressure roller 32 to form the fixing nip between the fixing belt 31 and the pressure roller 32. The pressure spring 35 may directly press the belt module or may press a lever pressing the belt module. The lever generates a large pressing force from a weak pressing force by the principle of leverage.

Figure 4:
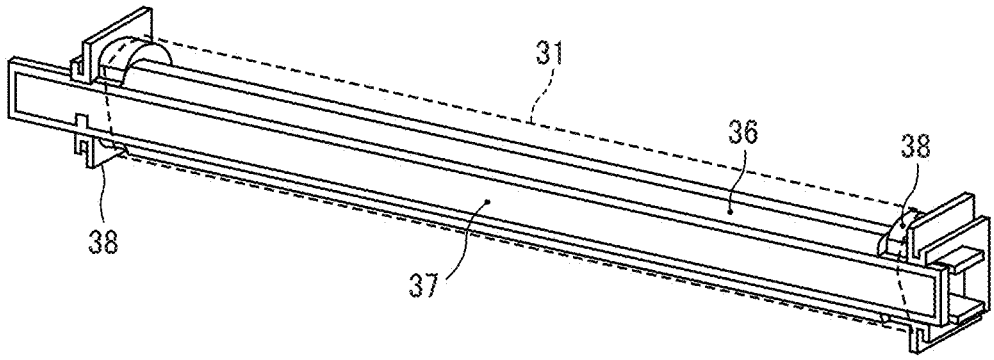
FIG. 4 is a perspective view of a belt module in the fixing device of FIG. 2.
Figure 5:
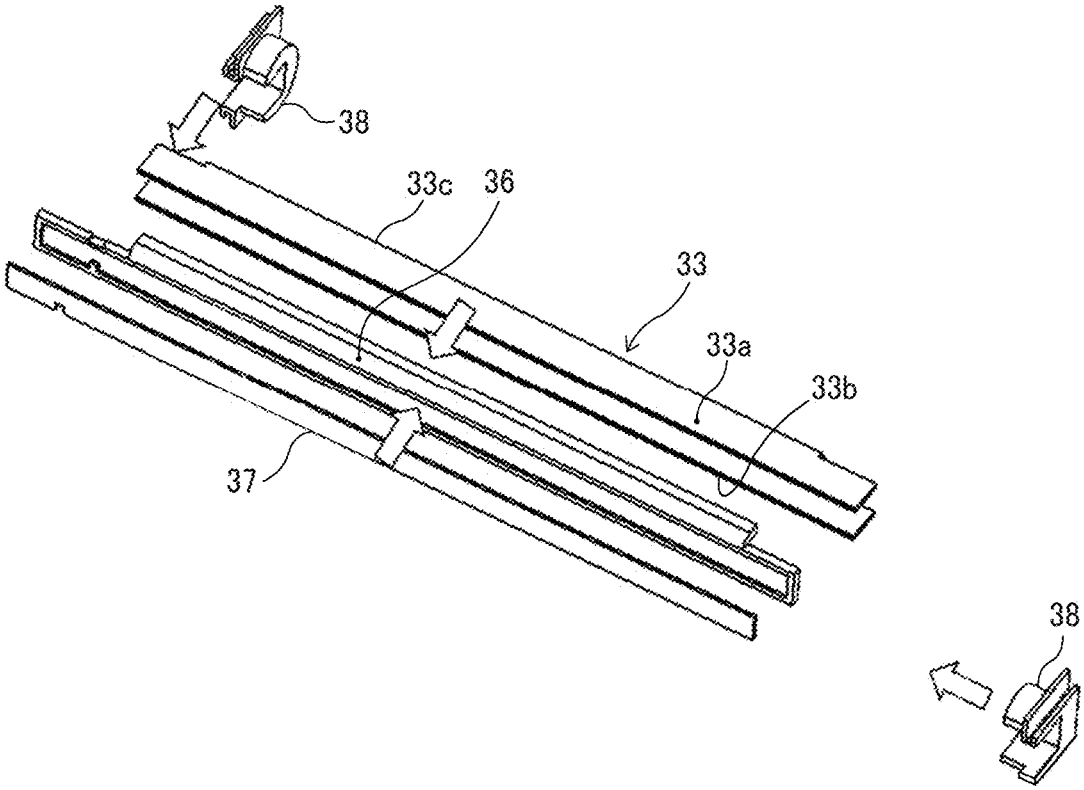
FIG. 5 is an exploded perspective view of the belt module of FIG. 4 in which the fixing belt is removed.

FIG. 4 is a perspective view of the belt module in the fixing device 30 of the present embodiment. FIG. 5 is an exploded perspective view of the belt module according to the present embodiment in which the fixing belt is removed.

The belt module according to the present embodiment includes a heater holder 36, a heater 37 held by the heater holder 36, right and left flanges 38 disposed at both ends of the belt module, and a stay 33 supporting the heater holder 36, which are inside the loop of the fixing belt 31 (in other words, inside a hollow of the fixing belt 31).

As illustrated in FIG. 5, the heater holder 36 has a recess having substantially the same outer shape as the heater 37, and the heater 37 is fitted into the recess. Since the heater holder 36 is in contact with the heater 37 and becomes a high temperature, the heater holder 36 is preferably made of a heat resistant material. In addition, it is preferable that the heater holder 36 is electrically insulative and has as low thermal conductivity as possible. For this reason, the heater holder 36 is preferably made of a heat-resistant resin material such as liquid crystal polymer (LCP) or polyether ether ketone (PEEK). The heater holder 36 made of the above-described heat-resistant resin can prevent heat transfer from the heater 37 to the heater holder 36, and accordingly, heat from the heater 37 can be efficiently transferred to the fixing belt 31.

The stay 33 supports a rear face of the heater holder 36 (that is a surface of the heater holder 36 opposite to a surface on which the heater 37 is disposed). The stay 33 has higher rigidity than the heater holder 36. As illustrated in FIG. 2, both ends of the stay 33 are supported by cutouts 30*a* in side plates of the first frame 30A. The stay 33 securely receives the pressing force from the pressure roller 32 to support the heater holder 36 so that the pressing force does not bend the heater holder 36. Accordingly, the part of the fixing belt 31 on the fixing nip SN is supported by the stay 33 via the heater holder 36. As a result, the fixing nip SN is formed with a desired pressure.

As illustrated in FIG. 5, the stay 33 of the present embodiment includes an upstream leg portion 33*a* that is an upstream side portion of the stay 33 in the sheet conveyance direction of the sheet P, a downstream leg portion 33*b* that is a downstream side portion of the stay 33 in the sheet conveyance direction of the sheet P, and a joint 33*c* connecting the upstream leg portion 33*a* and the downstream leg portion 33*b*. The stay 33 is made, for example, by bending one sheet metal so that the shape of the cross section orthogonal to the longitudinal direction is a U shape or a channel shape. The tip of the upstream leg portion 33*a* and the tip of the downstream leg portion 33*b* of the stay 33 are in contact with the back side of the heater holder 36 over the longitudinal direction of the heater holder 36 and support the heater holder 36 so that the heater holder 36 is not bent by the pressing force from the pressure roller 32.

Flanges 38 are disposed at both ends of the belt module. The flanges 38 are in contact with both ends of the inner circumferential surface of the fixing belt 31 to support the fixing belt 31. Further, the flanges 38 abut against both ends of the fixing belt 31 to restrict the skew of the fixing belt 31 that may occur when the fixing belt 31 is driven to rotate.

Figure 6:
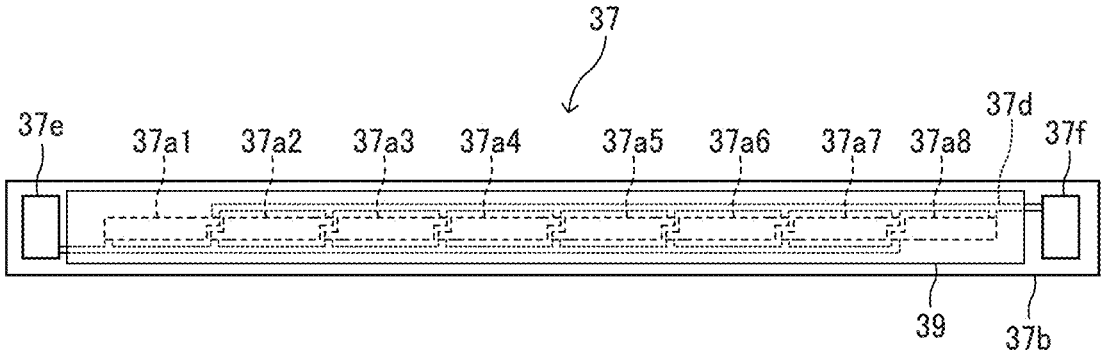
FIG. 6 is a plan view of a heater including an overcoat layer in the fixing device of FIG. 2 to illustrate an example of a configuration of the heater.
Figure 7:
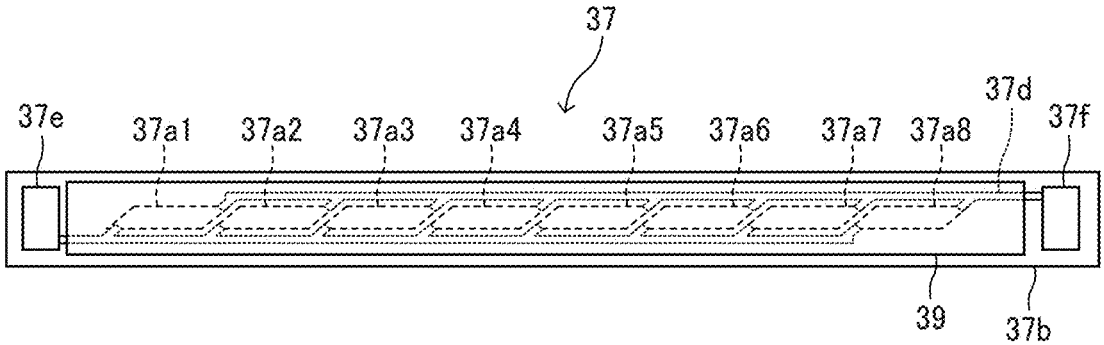
FIG. 7 is a plan view of a heater including the overcoat layer in the fixing device of FIG. 2 to illustrate another example of the configuration of the heater.

In the belt module of the present embodiment, the heater 37 and the heater holder 36, the heater holder 36 and the left flange 38, and the left flange 38 and the first frame 30A have positioning shapes for positioning each other in the longitudinal direction. The stay 33 is fitted to the left and right flanges 38 with some clearance (in other words, loose fit with play). The right flange 38 does not have a positioning shape to position the right flange 38 with respect to the heater holder 36 to prevent the thermal expansion of the heater holder 36 from applying a force to the first frame 30A FIG. 6 is a plan view of the heater 37 including an overcoat layer 39 in the fixing device 30 according to the present embodiment to illustrate a configuration of the heater 37. FIG. 7 is a plan view of the heater 37 including the overcoat layer 39 in the fixing device 30 according to the present embodiment to illustrate another configuration of the heater 37.

The heater 37 in the present embodiment includes a heater base 37*b*. On the heater base 37*b*, the heater 37 includes heat generation patterns 37*a*1 to 37*a*8, a conductor pattern 37*d* having a resistance value smaller than those of the heat generation patterns 37*a*1 to 37*a*8, and electrodes 37*e* and 37*f*. The heater 37 includes the overcoat layer 39 that is an insulation layer to cover the heat generation patterns 37*a*1 to 37*a*8 and the conductor pattern 37*d*.

The material of the heater base 37*b* is preferably ceramic such as alumina or aluminum nitride, glass, and mica that have excellent thermal resistance and insulating properties. The heater base 37*b* may be made by layering insulation material on conductive material such as metal. In the above materials, low-cost aluminum or stainless steel is preferable as the material of the heater base 37*b*. Since high thermal conduction of the materials having high thermal conductivity such as copper, graphite, or graphene uniforms the temperature of the entire heater, the high thermal conduction improves uniformity of fixing property, which improves an image quality. The heater base 37*b* in the present embodiment is an alumina base having a lateral width of 8 mm, a longitudinal width of 270 mm, and a thickness of 1.0 mm.

The heat generation patterns 37*a*1 to 37*a*8 are produced by, for example, mixing silver-palladium (AgPd), glass powder, and the like into a paste. The paste is coated on the heater base 37*b* by screen printing or the like. Thereafter, the heater base 37*b* is fired to form the heat generation patterns 37*a*1 to 37*a*8. The resistance values of the heat generation patterns 37*a*1 to 37*a*8 are, for example, set to 80Ω at room temperature. As the material of the heat generation patterns 37*a*1 to 37*a*8, a resistance material such as a silver alloy (AgPt) or ruthenium oxide (RuO2) may be used in addition to the materials described above. In the present embodiment, the conductor pattern 37*d* and the electrodes 37*e* and 37*f* are made by, for example, screen-printing silver (Ag) or silver palladium (AgPd).

A material of the overcoat layer 39 may be, for example, a thermal resistance glass having a thickness of 75 μm. The overcoat layer 39 is formed so as to cover the heat generation patterns 37*a*1 to 37*a*8 and the conductor pattern 37*d* on the heater base 37*b* to ensure insulation between the heat generation patterns 37*a*1 to 37*a*8 and the heater surface. The overcoat layer 39 also functions to ensure slidability with respect to the inner circumferential surface of the fixing belt 31.

The fixing belt 31 is in contact with the overcoat layer 39 of the heater 37. The heat generation patterns 37*a*1 to 37*a*8 generate heat, and the heat transfers to the fixing belt 31 to increase the temperature of the fixing belt 31. The fixing belt 31 heats an unfixed toner image borne on the sheet P conveyed to the fixing nip SN to fix the unfixed toner image onto the sheet P.

As illustrated in FIGS. 6 and 7, the heat generation patterns 37*a*1 to 37*a*8 are arranged in the longitudinal direction to form eight sections and electrically connected in parallel to each other. The heat generation patterns 37*a*1 to 37*a*8 are made of a material having a positive temperature coefficient of resistance (PTC) characteristic and have a characteristic that the resistance value increases as the temperature increases (in other words, the heater output decreases as the temperature increases). When the fixing device 30 fixies the unfixed toner image on the sheet P having a width narrower than the range of the heat generation patterns 37*a*1 to 37*a*8, the sheet P does not absorb heat of a part of the heat generation pattern outside the sheet in a sheet width direction (that is the longitudinal direction of the heater 37). Therefore, the temperature of the part of the heat generation pattern outside the sheet increases, and the above-described characteristic increases the resistance value of the part of the heat generation pattern outside the sheet. Since the voltage applied to the heat generation patterns 37*a*1 to 37*a*8 is constant, the output of the part of the heat generation pattern outside the sheet relatively decreases, preventing the temperature increase in the part of the heat generation pattern outside the sheet P.

The heat generation patterns 37*a*1 to 37*a*8 electrically connected in series needs to slow down an image forming speed (that is, printing speed) when the fixing device continuously fixes toner images to reduce the temperature rise at the part of the heat generation patterns 37*a*1 to 37*a*8 outside the sheet in the sheet width direction. In contrast, the configuration of the present embodiment does not need to slow down the image forming speed in order to reduce the temperature rise of the part of the heat generation pattern, which can improve the productivity.

The heat generation patterns 37*a*1 to 37*a*8 arranged in parallel in the longitudinal direction are spaced apart from each other to ensure insulation between the heat generation patterns. Since the regions between the heat generation patterns do not generate heat, temperatures at the regions decrease. Therefore, as illustrated in FIGS. 6 and 7, it is preferable that the heat generation patterns are arranged so as to overlap with each other in the longitudinal direction to prevent the temperatures at the regions from decreasing. The heat generation patterns 37*a*1 to 37*a*8 may be formed by folding back a heating element material so as to obtain a desired output (in other words, a desired resistance value).

Hereinafter, the fixing device 30 according to the present embodiment is described in more detail.

Figure 8:
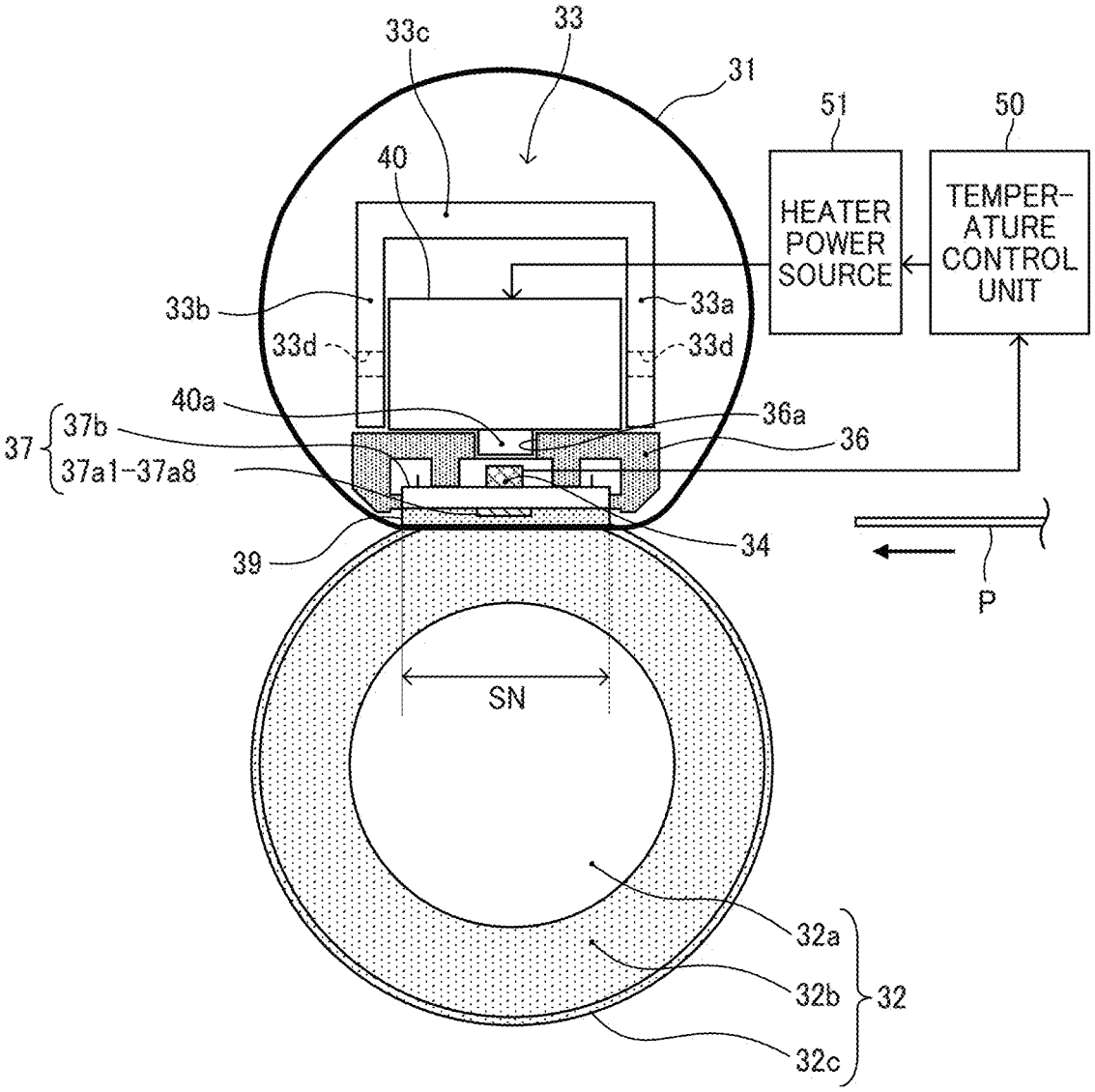
FIG. 8 is a schematic diagram illustrating an internal configuration inside a loop of the fixing belt in the fixing device of FIG. 2.

FIG. 8 is a schematic diagram illustrating an internal configuration inside the fixing belt 31 in the fixing device 30 according to the present embodiment.

As illustrated in FIG. 8, the fixing device 30 according to the present embodiment includes the fixing belt 31 and the pressure roller 32. The fixing belt 31 is an endless belt serving as the fixing rotator. The pressure roller 32 serves as the opposing rotator or the opposing member forming the fixing nip SN between the fixing belt 31 and the pressure roller 32.

The fixing belt 31 is a member that heats and fixes the toner image to the sheet P. The fixing belt 31 of the present embodiment includes a tubular base made of polyimide (PI), and the tubular base has an outer diameter of 25 mm and a thickness of 40 μm or more and 120 μm or less. The fixing belt 31 further includes a release layer serving as an outermost circumferential surface layer. The release layer is made of fluororesin, such as tetrafluoroethylene-perfluoroalkylvinylether copolymer (PFA) or polytetrafluoroethylene (PTFE), and has a thickness in a range of from 5 μm to 50 μm to enhance durability of the fixing belt 31 and facilitate separation of the sheet P and a foreign substance from the fixing belt 31. An elastic layer made of rubber having a thickness of from 50 μm to 500 μm may be interposed between the base and the release layer. The base of the fixing belt 31 may be made of heat resistant resin such as polyetheretherketone (PEEK) or metal such as nickel (Ni) or steel use stainless (SUS), instead of polyimide. The inner circumferential surface of the fixing belt 31 may be coated with polyimide or polytetrafluoroethylene (PTFE) as a slide layer.

The pressure roller 32 of the present embodiment has an outer diameter of 25 mm and includes a solid iron cored bar 32*a*, an elastic layer 32*b* on the surface of the cored bar 32*a*, and a release layer 32*c* as the outermost circumferential layer formed on the outside of the elastic layer 32*b*. The elastic layer 32*b* is made of, for example, silicone rubber, and has a thickness of, for example, 3.5 mm. The release layer 32*c* is made of a fluororesin layer having, for example, a thickness of approximately 40 μm on the surface of the elastic layer 32*b* to improve releasability.

As illustrated in FIG. 8, the heater holder 36 contacts the back side of the heater base 37*b* at two positions not facing the heat generation patterns 37*a*1 to 37*a*8 to prevent heat transfer from the heater 37 to the heater holder 36.

As illustrated in FIG. 8, the fixing device 30 in the present embodiment includes a thermistor 34 as a temperature detector to detect the temperature of a heater 37 inside the heater holder 36. Specifically, the thermistor 34 is disposed on the back side of the heater base 37*b* of the heater 37 (that is the side opposite to the side on which the heat generation patterns 37*a*1 to 37*a*8 are disposed). The temperature detected by the thermistor 34 is transmitted to a temperature control unit 50.

Based on the temperature detected by the thermistor 34, the temperature control unit 50 performs a fixing temperature control that controls a heater power source 51 to supply power to the heater 37 so that the temperature of the fixing belt 31 is a target temperature. The temperature control unit 50 may be configured by a microcomputer including a central processing unit (CPU), a read only memory (ROM) a random-access memory (RAM), an input and output (I/O) interface, and the like. The temperature control unit 50 may perform the fixing temperature control based on the temperature detected by the thermistor 34 but may perform the fixing temperature control based on other parameters in addition to the temperature detected by the thermistor 34.

As illustrated in FIG. 8, the fixing device 30 according to the present embodiment also includes a thermostat 40 as another temperature detector to detect the temperature of the heater 37. The thermostat 40 is disposed in an internal space of the stay 33 that is a space surrounded by the upstream leg portion 33*a*, the downstream leg portion 33*b*, the joint 33*c*, and the back side of the heater holder 36. A detection portion 40*a* of the thermostat 40 detects temperature and is fitted into an opening 36*a* of the heater holder 36 to position the thermostat 40 in the longitudinal direction. In the sheet conveyance direction, the thermostat 40 is positioned by interposing the thermostat 40 between the upstream leg portion 33*a* and the downstream leg portion 33*b* of the stay 33.

The thermostat 40 is connected to a power path from the heater power source 51 to the heater 37. In response to detecting the temperature of the heater 37 over the predetermined upper limit temperature, the thermostat 40 shuts off the power supply from the heater power source 51 to the heater 37. As a result, the temperature of the heater 37 is controlled so as not to exceed the upper limit temperature, and safety is ensured.

Reducing the size of the fixing belt 31 needs reducing the size of the stay 33 that is a conductive support disposed in the hollow of the fixing belt 31 (in other words, a space surrounded by the inner circumferential surface of the endless fixing belt 31). Reducing the dimension of the stay 33 in the sheet conveyance direction that is the lateral direction in FIG. 8 and the dimension of the stay in the pressing direction of the fixing nip that is the vertical direction in FIG. 8 can shorten the circumferential length of the fixing belt 31 and reduce the size of the fixing belt 31.

Figure 9A:
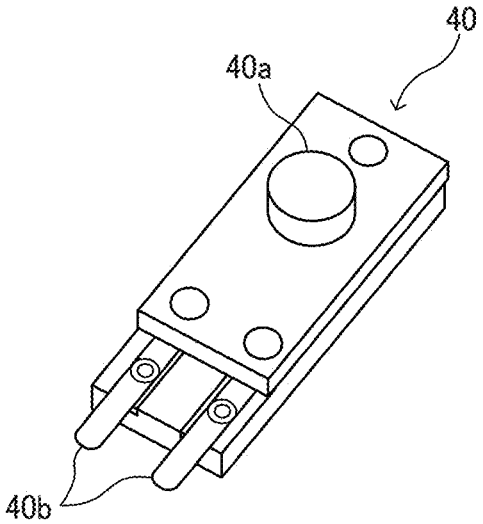
FIG. 9A is a perspective view of a thermostat in the fixing device of FIG. 2.
Figure 9B:
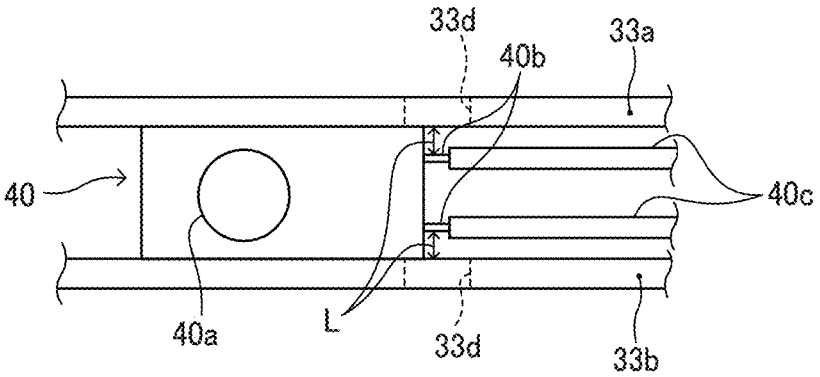
FIG. 9B is a partial sectional view of a stay in which the thermostat of FIG. 9A is disposed, viewed from a detection portion of the thermostat.

As illustrated in FIGS. 9A and 9B, the thermostat 40 typically includes the detection portion 40*a* and two terminals 40*b*. The detection portion 40*a* and the two terminals 40*b* are exposed to the outside. As illustrated in FIG. 9B, the wirings 40*c* are connected to the two terminals 40*b* by soldering, and the thermostat 40 is installed in the internal space of the stay 33. The two terminals 40*b* of the thermostat 40 are conductors and exposed, which are referred to as exposed conductive portions.

The above-described thermostat 40 is disposed in the internal space of the stay 33. Reducing the size of the stay 33 that is the conductive support shortens a distance between the exposed conductive portion (the terminal 40*b*) of the thermostat 40 and a portion of the stay 33 facing the exposed conductive portion. For example, in the present embodiment, reducing the distance between the upstream leg portion 33*a* and the downstream leg portion 33*b* of the stay 33 reduces the size of the stay 33 in the sheet conveyance direction. As illustrated in FIG. 9B, the above-described configuration shortens the distance L that is each of a distance between the upstream leg portion 33*a* of the stay 33 and the exposed conductive portion (one of the terminals 40*b*) of the thermostat 40 facing the upstream leg portion 33*a* and a distance between the downstream leg portion 33*b* of the stay 33 and the exposed conductive portion (the other one of the terminals 40*b*) facing the downstream leg portion 33*b*. The configuration in which the thermostat 40 is held between the upstream leg portion 33*a* and the downstream leg portion 33*b* of the stay 33 especially shortens the distance L. The distance L is very short.

Accordingly, reducing the size of the stay 33 is likely to cause a short circuit or the like between the stay 33 and the exposed conductive portion (that is, the terminal 40*b*) of the thermostat 40. Then, it is difficult for the thermostat 40 to appropriately detect the temperature. As a result, an appropriate operation of the fixing device 30 (such as an operation of controlling the temperature of the heater 37 so as not to exceed a predetermined upper limit temperature) may be prevented.

Interposing an insulation member between the exposed conductive portion (the terminal 40*b*) of the thermostat 40 and a portion of the stay 33 facing the exposed conductive portion can prevent occurrence of the short circuit described above. However, interposing the insulation member increases the size of the stay 33 by the thickness of the insulation member and does not sufficiently meet the demand for reduction in size.

Figure 10A:
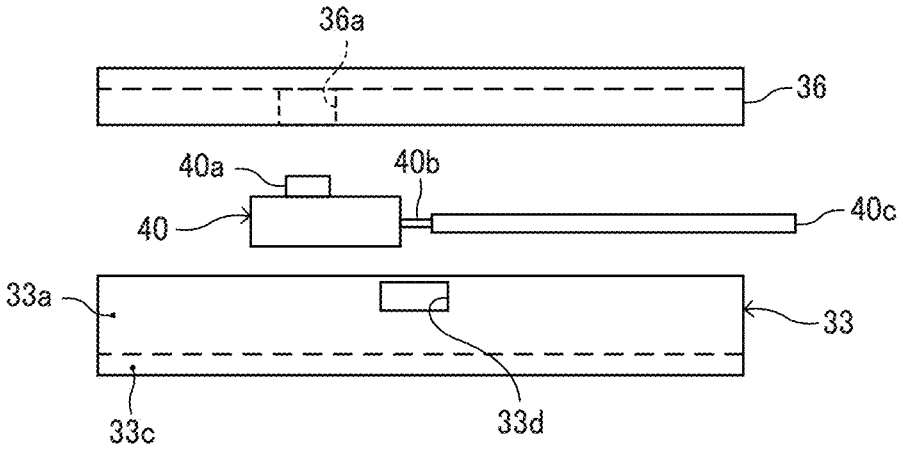
FIG. 10A is a side view of a state before the thermostat is attached to a heater holder and disposed inside the stay in the fixing device of FIG. 2.
Figure 10B:
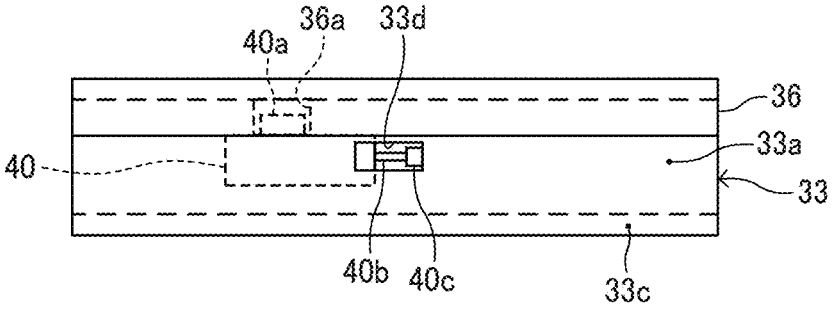
FIG. 10B is a side view of a state after the thermostat is attached to a heater holder and disposed inside the stay in the fixing device of FIG. 2.

In the present embodiment, as illustrated in FIGS. 10A and 10B, the stay 33 has an opening 33*d* at a portion facing the exposed conductive portion (that is, the terminal 40*b*) of the thermostat 40. Specifically, each of the upstream leg portion 33*a* and the downstream leg portion 33*b* of the stay 33 has the opening 33*d* at the position facing the exposed conductive portion (that is, the terminal 40*b*) of the thermostat 40 installed in the internal space of the stay 33.

The above-described opening 33*d* increases the distance (the closest distance) between the stay 33 and the exposed conductive portion (that is, the terminal 40*b*) of the thermostat 40 even if the size of the stay 33 is reduced. Therefore, even if the size of the stay 33 is reduced, the above-described configuration can prevent the occurrence of the short circuit or the like.

Figure 11:
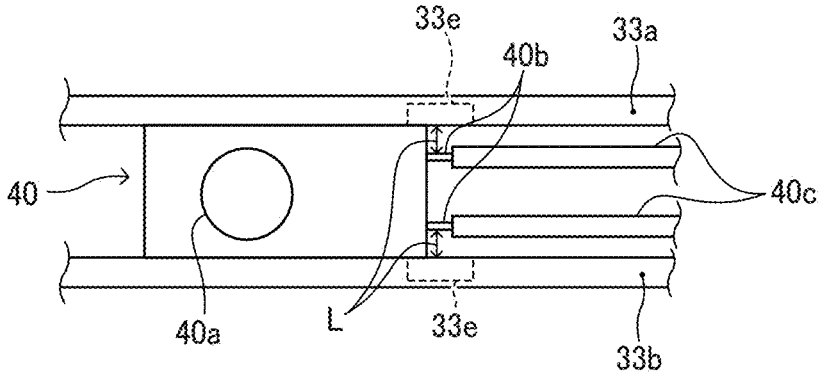
FIG. 11 is a partial sectional view of a stay according to another embodiment having recessed portions, viewed from a detection portion of the thermostat.

The stay 33 in the present embodiment has the openings 33*d* that are through-holes at the portions facing the exposed conductive portions (that is, the terminals 40*b*) of the thermostat 40, but the present disclosure is not limited to this. The stay may have recessed portions 33*e* at the portions facing the exposed conductive portions as illustrated in FIG. 11. Specifically, each of the upstream leg portion 33*a* and the downstream leg portion 33*b* of the stay 33 may have the recessed portion in an internal wall of the stay 33 facing the exposed conductive portion (that is, the terminal 40*b*) of the thermostat 40 installed in the internal space of the stay 33.

In the present embodiment, reducing the distance between the upstream leg portion 33*a* and the downstream leg portion 33*b* of the stay 33 reduces the size of the stay 33 in the sheet conveyance direction, but the present disclosure is not limited to this. For example, the present disclosure may be applied to another embodiment in which reducing the heights of the upstream leg portion 33*a* and the downstream leg portion 33*b* of the stay 33 (in other words, lengths of the upstream leg portion 33*a* and the downstream leg portion 33*b* in the pressing direction in which the pressure roller presses the fixing belt at the fixing nip) reduces the size of the stay 33 in the pressing direction. In the above-described embodiment, since the joint 33*c* of the stay 33 is close to the exposed conductive portions (that is, the terminals 40*b*) of the thermostat 40, the joint 33*c* has the openings 33*d*. The joint 33*c* may have one opening 33*d* facing the terminals 40*b*.

The stay 33 in the present embodiment has the openings 33*d* in both of the upstream leg portion 33*a* and the downstream leg portion 33*b* of the stay 33, but the present disclosure is not limited to this. One of the upstream leg portion 33*a* and the downstream leg portion 33*b* of the stay 33 may have the opening 33*d*, and the other one of the upstream leg portion 33*a* and the downstream leg portion 33*b* of the stay 33 may not have the opening 33*d*. The above-described embodiment may be applied to, for example, the fixing device including the thermostat 40 disposed nearer to the upstream leg portion 33*a* than the downstream leg portion 33*b* in the internal space of the stay 33 in the sheet conveyance direction, the fixing device including the thermostat 40 disposed nearer to the downstream leg portion 33*b* than the upstream leg portion 33*a* in the internal space of the stay 33 in the sheet conveyance direction, the fixing device including the thermostat 40 having the exposed conductive portions (the terminals 40*b*) disposed nearer to the upstream side of the thermostat 40 than the downstream side of the thermostat 40 in the sheet conveyance direction, or the fixing device including the thermostat 40 having the exposed conductive portions (the terminals 40*b*) disposed nearer to the downstream side of the thermostat 40 than the upstream side of the thermostat 40 in the sheet conveyance direction. In this case, the opening 33*d* may be in one of the upstream leg portion 33*a* and the downstream leg portion 33*b* that are closer to the exposed conductive portions (that is, the terminals 40*b*) of the thermostat 40 than the other one of the upstream leg portion 33*a* and the downstream leg portion 33*b*.

In the present embodiment, the temperature detector disposed in the internal space of the stay 33 is a thermostat 40 which is disposed separately from the thermistor 34 to control the fixing temperature to the target temperature and is used to turn off the power supply to the heater 37 in response to exceeding the fixing temperature over the upper limit temperature. The present disclosure is not limited to this. The temperature detector disposed in the internal space of the stay 33 may be a temperature detector used to control the fixing temperature to the target temperature.

The opening 33*d* of the present embodiment may have any size and shape as long as the distance (the closest distance) between the exposed conductive portion (that is, the terminal 40*b*) of the thermostat 40 and the stay 33 is enough to prevent the short circuit. However, the opening 33*d* may have a size larger than the above-described size or a shape different from the above-described shape when the opening 33*d* has a function other than the function of preventing the short circuit. The example of the function is as follows. The opening or the recessed portion may be disposed in the stay 33 to produce the stay 33 or reduce the weight of the stay 33. The opening may be a viewing window through which the thermostat 40 disposed in the inner space of the stay 33 is viewed from the outside of the stay 33.

The configurations according to the above-descried embodiments are not limited thereto. This disclosure can achieve the following aspects effectively.

First Aspect

In a first aspect, a fixing device such as the fixing device 30 includes a fixing rotator, an opposing rotator, a temperature detector, and a support. The fixing rotator such as the fixing belt 31 includes a hollow. The fixing rotator heats an image such as the toner image and fixes the image onto a recording medium such as the sheet P. The opposing rotator such as the pressure roller 32 forms a fixing nip such as the fixing nip SN between the fixing rotator and the opposing rotator. The temperature detector such as the thermostat 40 or the thermistor 34 includes an exposed conductive portion such as the exposed conductive portion that is the terminal 40*b*. The support such as the stay 33 has conductivity and is disposed in the hollow of the fixing rotator to support the fixing rotator at the fixing nip. The support has at least one of a recessed portion such as the recessed portion 33*e* or an opening such as the opening 33*d* at a position facing the exposed conductive portion of the temperature detector.

To reduce the size of the fixing device, the size of the fixing rotator is reduced. Reducing the size of the fixing rotator results in reducing the size of the conductive support disposed inside the hollow of the fixing rotator. Reducing the size of the conductive support shortens a distance between the exposed conductive portion of the temperature detector and a portion of the conductive support facing the exposed conductive portion. As the conductive support including the temperature detector inside the conductive support is made smaller, the distance between the conductive support and the exposed conductive portion is shorter. As a result, reducing the size of the conductive support is likely to cause the short circuit between the conductive support and the exposed conductive portion of the temperature detector, and appropriate temperature detection by the temperature detector becomes difficult, which may prevent an appropriate operation of the fixing device. Interposing an insulation member between the exposed conductive portion of the temperature detector and a portion of the conductive support facing the exposed conductive portion can prevent occurrence of the short circuit described above. However, interposing the insulation member increases the size of the conductive support by the thickness of the insulation member and does not sufficiently meet the demand for reduction in size.

In the first aspect, at least one of the recessed portion and the opening portion that are disposed at the portion of the conductive support facing the exposed conductive portion of the temperature detector increases the closest distance between the exposed conductive portion of the temperature detector and the conductive support even if the size of the conductive support is reduced. Therefore, even if the size of the conductive support is reduced, the above-described configuration can prevent the occurrence of the short circuit or the like. According to the first aspect, even if the size of the conductive support is reduced to reduce the size of the fixing rotator, the temperature detector can appropriately detect the temperature, and the fixing device can suitably function.

Second Aspect

In a second aspect, the fixing device according to the first aspect includes the support including an upstream support such as the upstream leg portion 33*a* and a downstream support such as the downstream leg portion 33*b* disposed downstream from the upstream support in a recording medium conveyance direction such as the sheet conveyance direction, and at least one of the upstream support and the downstream support has the at least one of the recessed portion such as the recessed portion 33*e* or the opening such as the opening 33*d*.

According to the second aspect, even if the size of the conductive support is reduced by reducing the size of the conductive support in the recording medium conveyance direction, the temperature detector can appropriately detect the temperature, and the fixing device can suitably function.

Third Aspect

In a third aspect, the fixing device according to the second aspect includes one of the upstream support and the downstream support nearer to the exposed conductive portion than the other one of the upstream support and the downstream support, and the one of the upstream support and the downstream support nearer to the exposed conductive portion has the at least one of the recessed portion or the opening. The other one of the upstream support and the downstream support does not have the at least one of the recessed portion or the opening.

According to the third aspect, the number of recessed portions or openings formed in the conductive support can be reduced.

Fourth Aspect

In a fourth aspect, the fixing device according to any one of the first to third aspect includes the support including an upstream support such as the upstream leg portion 33*a*, a downstream support such as the downstream leg portion 33*b* disposed downstream from the upstream support in a recording medium conveyance direction such as the sheet conveyance direction, and a joint such as the joint 33*c* connecting the upstream support and the downstream support. The joint has the at least one of the recessed portion and the opening. According to the fourth aspect, even if the size of the conductive support is reduced by reducing the size of the conductive support in a direction orthogonal to the recording medium conveyance direction, the temperature detector can appropriately detect the temperature, and the fixing device can suitably function. Fifth Aspect In a fifth aspect, the fixing device according to any one of the first to fourth aspect includes the exposed conductive portion that is a terminal such as the terminal 40*b* of the temperature detector.

The configuration according to the fifth aspect prevents the occurrence of the short circuit between the terminal of the temperature detector and the conductive support even if the size of the conductive support is reduced.

Sixth Aspect

In a sixth aspect, the fixing device according to any one of the first to fifth aspect includes the temperature detector that is a thermostat such as the thermostat 40.

Since the thermostat 40 is relatively larger than other temperature detectors such as the thermistor 34, reducing the size of the conductive support including the thermostat 40 inside the conductive support is likely to cause the short circuit between the conductive support and the exposed conductive portion of the thermostat 40. The configuration according to the sixth aspect prevents the occurrence of the short circuit between the terminal of the temperature detector and the conductive support even if the temperature detector is the thermostat as described above.

Seventh to Ninth Aspects

In a seventh aspect, the fixing device according to any one of the first to sixth aspects has the at least one of the recessed portion and the opening configured to use during production of the fixing device. In an eighth aspect, the fixing device according to any one of the first to seventh aspects has the opening that is a viewing window configured to view the temperature detector from the outside of the support. In a ninth aspect, the fixing device according to any one of the first to eighth aspects has the at least one of the recessed portion and the opening configured to decrease a weight of the fixing device.

According to this configuration, the recessed portion or the opening to prevent the occurrence of the short circuit between the exposed conductive portion of the temperature detector and the conductive support can be used for other purposes.

Tenth Aspect

In a tenth aspect, an image forming apparatus such as the image forming apparatus 1 includes the fixing device according to any one of the first to ninth aspects.

According to the tenth aspect, the image forming apparatus including the fixing device that is downsized but appropriately operates is provided.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

What is claimed is:

1. A fixing device comprising:

a fixing rotator having a hollow, the fixing rotator being configured to heat an image and fix the image onto a recording medium;

an opposing rotator configured to form a fixing nip between the fixing rotator and the opposing rotator;

a temperature detector including a terminal; and a support in the hollow of the fixing rotator to support the fixing rotator at the fixing nip, the support being conductive, the support having a curved shape, the support having at least one of a recessed portion or an opening at a first position along the curved shape, and the first position facing the terminal of the temperature detector.

2. The fixing device according to claim 1, wherein the support includes an upstream support and a downstream support, the downstream support being downstream from the upstream support in a conveyance direction of the recording medium; and at least one of the upstream support or the downstream support has the at least one of the recessed portion or the opening.

3. The fixing device according to claim 2, wherein one among the upstream support and the downstream support nearer to the terminal than another one among the upstream support and the downstream support has the at least one of the recessed portion or the opening, the other one among the upstream support and the downstream support not having the at least one of the recessed portion or the opening.

4. The fixing device according to claim 1, wherein the support includes:

an upstream support;

a downstream support downstream from the upstream support in a conveyance direction of the recording medium; and a joint connecting the upstream support and the downstream support, the joint having the at least one of the recessed portion or the opening.

5. The fixing device according to claim 1, wherein the temperature detector is a thermostat.

6. The fixing device according to claim 1, wherein the opening is a viewing window through which the temperature detector is visible from a second position outside of the support.

7. An image forming apparatus comprising the fixing device according to claim 1.

8. The fixing device according to claim 1, wherein the curved shape of the support is a U-shape.

9. The fixing device according to claim 1, wherein the temperature detector includes a plurality of exposed conductive portions, the terminal being among the plurality of exposed conductive portions; and the support has a plurality of recessed portions or openings at a plurality of corresponding positions along the curved shape, each of the plurality of corresponding positions facing a respective exposed conductive portion among the plurality of exposed conductive portions, the at least one of a recessed portion or an opening being among the plurality of recessed portions or openings, and the first position being among the plurality of corresponding positions.

10. The fixing device according to claim 9, wherein the support includes an upstream support, a downstream support downstream from the upstream support in a conveyance direction of the recording medium, and a joint connecting the upstream support and the downstream support;

and the plurality of corresponding positions are on two or more among the upstream support, the downstream support and the joint.

11. The fixing device according to claim 10, wherein all of the plurality of exposed conductive portions are terminals of the temperature detector.

12. The fixing device according to claim 11, wherein the temperature detector is a thermostat.

13. The fixing device according to claim 10, wherein the temperature detector is a thermostat.

14. The fixing device according to claim 1, wherein the temperature detector includes three exposed conductive portions, the terminal being among the three exposed conductive portions; and the support has three recessed portions or openings at three corresponding positions along the curved shape, each of the three corresponding positions facing a respective exposed conductive portion among the three exposed conductive portions, the at least one of a recessed portion or an opening being among the three recessed portions or openings, and the first position being among the three corresponding positions.

15. The fixing device according to claim 14, wherein the support includes an upstream support, a downstream support downstream from the upstream support in a conveyance direction of the recording medium, and a joint connecting the upstream support and the downstream support;

and the three corresponding positions are on the upstream support, the downstream support and the joint, respectively.

16. The fixing device according to claim 15, wherein all of the three exposed conductive portions are terminals of the temperature detector.

17. The fixing device according to claim 16, wherein the temperature detector is a thermostat.

18. The fixing device according to claim 15, wherein the temperature detector is a thermostat.

* * * * *